US005653532A

United States Patent [19]

Chan

[11] Patent Number: 5,653,532

[45] Date of Patent: Aug. 5, 1997

[54] LAMP DEVICE

[76] Inventor: Bobby Chan, No. 203 Wu Chiuan Nan Road, Taichung City, Taiwan

[21] Appl. No.: 651,350

[22] Filed: May 22, 1996

[51] Int. Cl.[6] ..... F21V 17/00

[52] U.S. Cl. ..... 362/453; 362/295; 362/375

[58] Field of Search ..... 362/96, 295, 294, 362/362, 363, 374, 375, 311, 451, 453, 455

[56] References Cited

U.S. PATENT DOCUMENTS

| | | | |
|---|---|---|---|
| 3,059,137 | 10/1962 | Reaves | 362/295 |
| 3,555,269 | 1/1971 | Gardner | 362/451 |
| 4,432,045 | 2/1984 | Merritt | 362/453 |

*Primary Examiner*—Ira S. Lazarus

*Assistant Examiner*—Y. Quach

*Attorney, Agent, or Firm*—Morton J. Rosenberg; David I. Klein

[57] ABSTRACT

A lamp device includes three resilient blades extended downward from a housing. The housing includes a lower peripheral flange extended radially inward and having an opening. A switch is secured to a panel of a plate which is fixed in the housing. A cover of light transmissible material is engaged in the housing and has a peripheral rib extended radially outward for engaging with the peripheral flange of the housing so as to be supported in the housing. The resilient blade is engaged with the peripheral rib of the cover so as to stably retain the cover in place.

2 Claims, 6 Drawing Sheets

LAMP DEVICE

BACKGROUND OF THE INVENTION

1. Field of the Invention

The present invention relates to a lamp, and more particularly to a lamp device having a shielded switch.

2. Description of the Prior Art

Typical lamp devices, particularly the lamp devices for attaching to the ceiling fans, comprise a switch 91 including a threaded tube 92 engaged through a wall member 93 of a lamp shade or a control box 90 of the ceiling fan. The threaded tube 92 is secured to the wall member 93 by a nut 94 which is engaged on the outer portion of the wall member 93. The switch 91 includes a chain 95 extended outward of the wall member 93 through the threaded tube 92 and the nut 94. However, the nut 94 should be tightly threaded to the threaded tube 92 and should be tightly engaged with the outer surface of the wall member 93 such that the switch 91 may be stably secured in place. However, the outer surface, particularly the outer painting layer of the wall member 93 may thus be damaged by the nut 94.

The present invention has arisen to mitigate and/or obviate the afore-described disadvantages of the conventional lamp devices.

SUMMARY OF THE INVENTION

The primary objective of the present invention is to provide a lamp device which includes a switch that is shielded and protected in the housing so as to be prevented from damaging the outer surface of the lamp housing or the control box of the ceiling fan.

In accordance with one aspect of the invention, there is provided a lamp device comprising a housing including at least one resilient blade disposed therein and extended downward therefrom, and including a lower peripheral flange extended radially inward therefrom, the peripheral flange including at least one opening formed therein, a plate including a panel extended therefrom, means for fixing the plate to the housing, a switch fixed to the panel and including a chain extended there from for engaging with the opening of the peripheral flange so as to allow the chain to be extended outward of the housing, a cover made of light transmissible material and engaged in the housing, the cover including a peripheral rib extended radially outward therefrom for engaging with the peripheral flange of the housing so as to be supported in the housing. The resilient blade is engaged with the peripheral rib of the cover so as to stably retain the cover in place.

The peripheral rib includes at least one notch for engaging with the switch so as to allow the cover to be engaged inward of the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
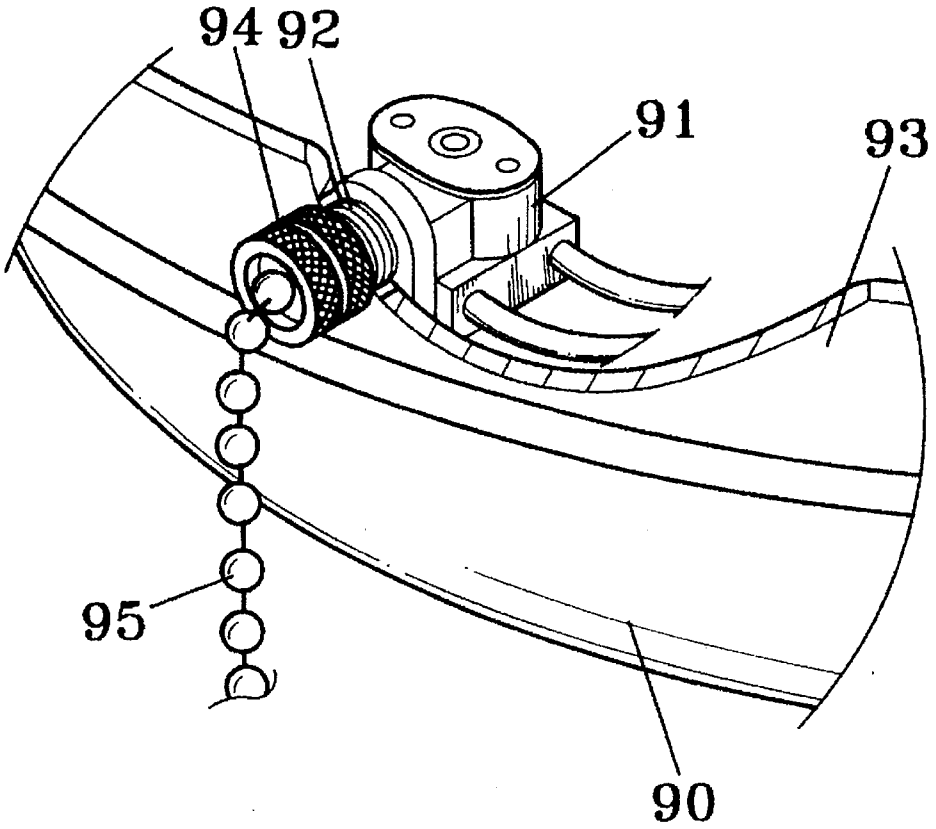
PRIOR ART FIG. 1
FIG. 1 is a partial perspective view of a typical switch for a typical lamp device.
Figure 2:
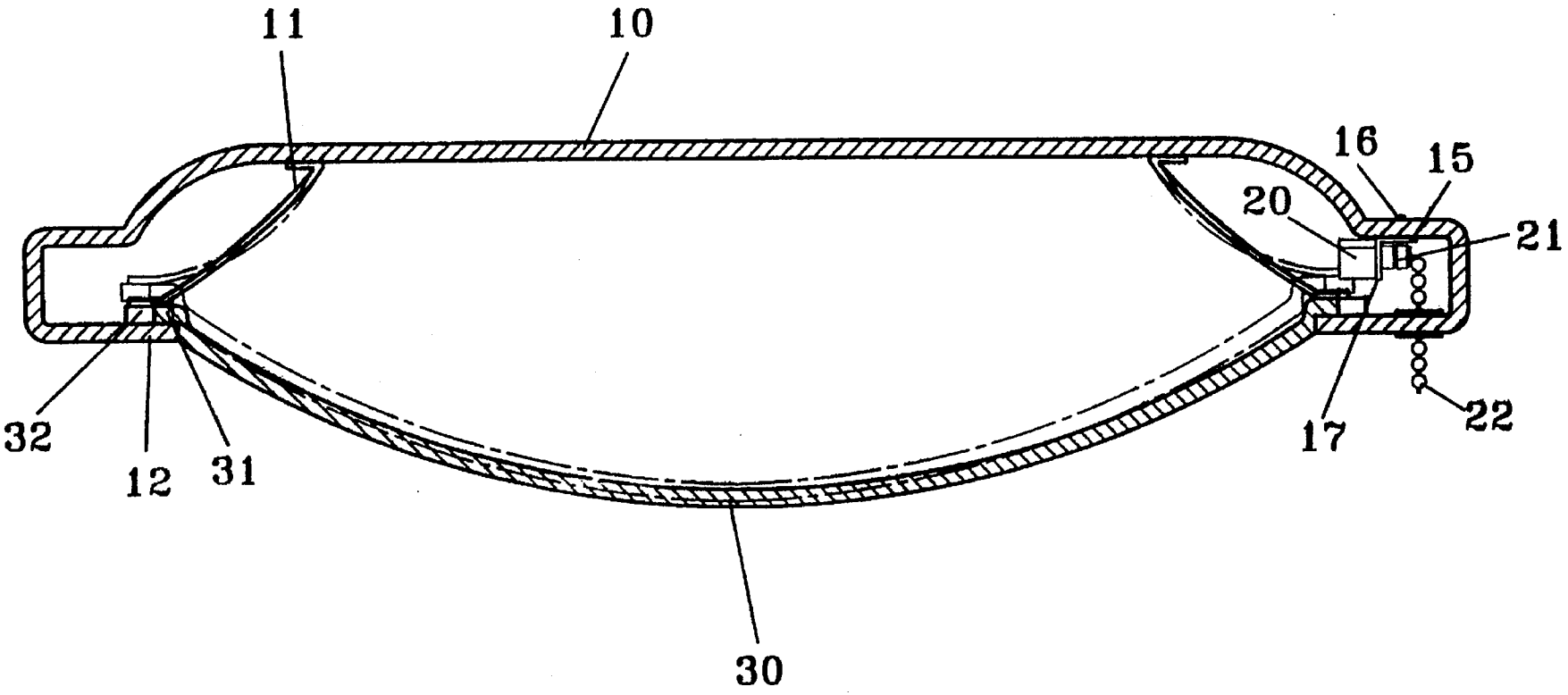
FIG. 2 is a cross sectional view of a lamp device in accordance with the present invention.
Figure 3:
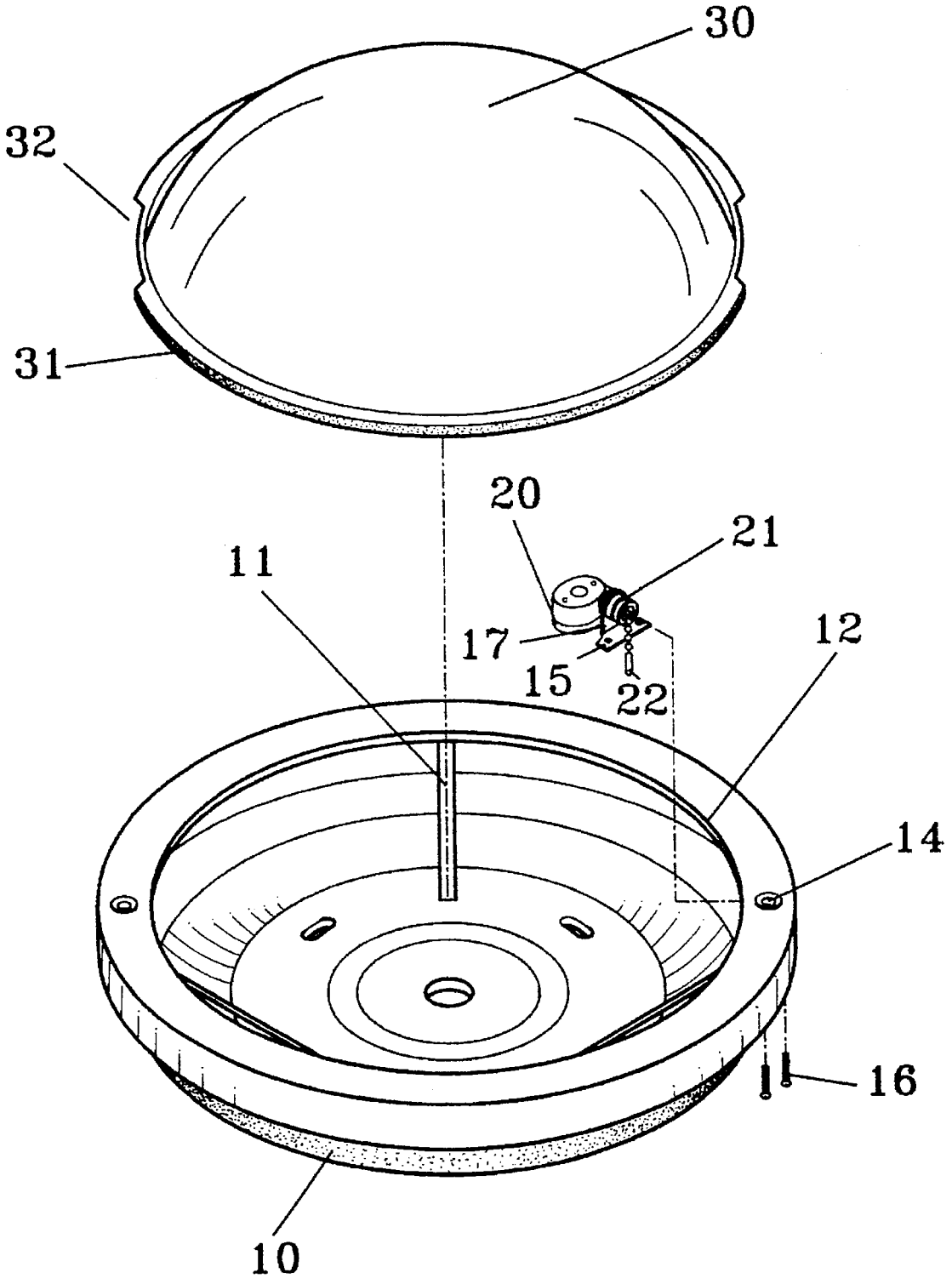
FIG. 3 is an exploded view of the lamp device.
Figure 4:
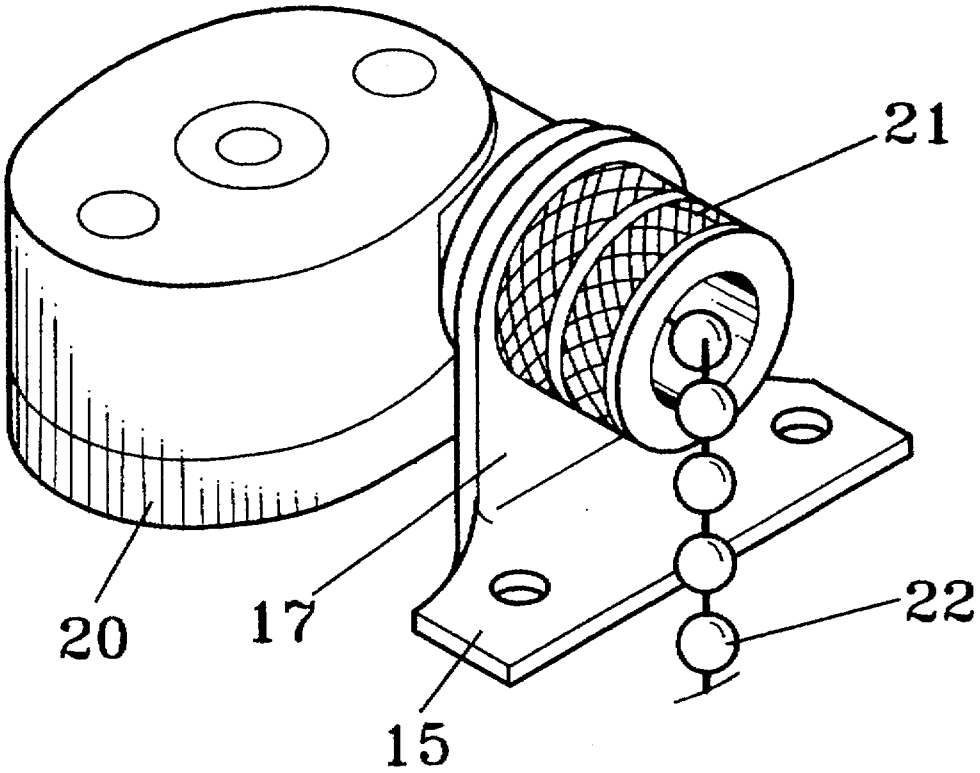
FIG. 4 is a perspective view of the switch.

Referring to the drawings, and initially to FIGS. 2 to 4, a lamp device in accordance with the present invention comprises a housing 10 including three resilient blades 11 disposed therein and extended downward, and including a lower peripheral flange 12 extended radially inward therefrom. A plate 15 is fixed to the inner portion of the housing 10 by fastening screws 16 and includes a panel 17 arranged substantially in perpendicular to the plate 15. A switch 20 is fixed to the panel 17 by a nut 21 and includes a chain 22 extended through the nut 21. The peripheral flange 12 includes one or more openings 14 (FIG. 3) formed therein for engaging with the chain 22 and for allowing the chain 22 to be extended downward and outward of the housing 10 (FIG. 2). A cover 30 is made of light transmissible material and is deformable such that the cover 30 may be slightly deformed and engaged into the housing 10. The cover 30 includes a peripheral rib 31 extended radially outward therefrom for engaging with the peripheral flange 12 of the housing 10 so as to be supported in the housing 10. The resilient blades 11 may engage with the peripheral rib 31 of the cover 30 so as to stably retain the cover 30 in place. The peripheral rib 31 includes one or more notches 32 formed therein for engaging with the switch 20 such that the switch 20 will not engage with and will not prevent the cover 30 from engaging inward of the housing 10.

Figure 5:
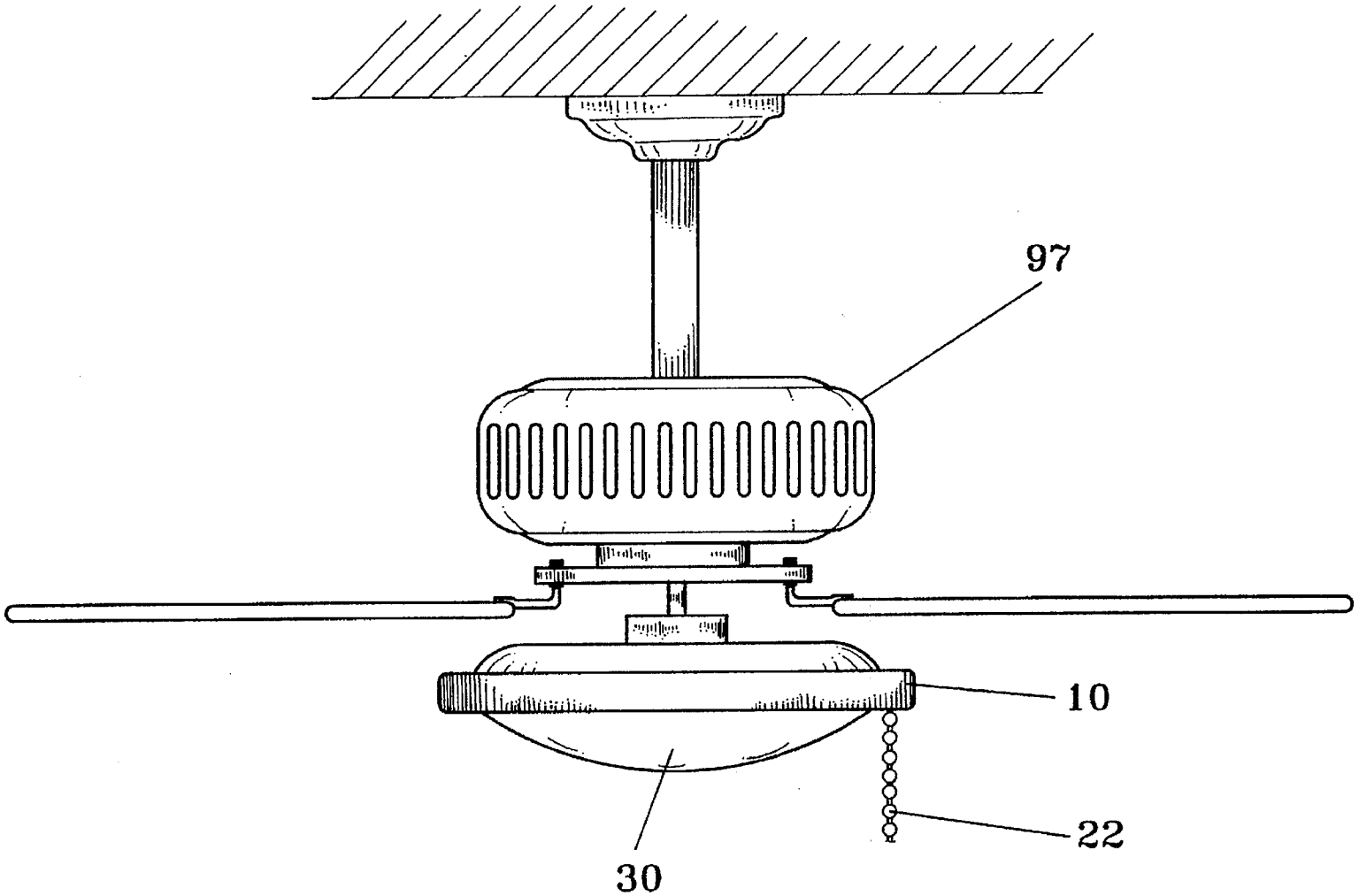
FIGS. 5 and 6 are plane views illustrating the applications of the lamp device.
Figure 6:
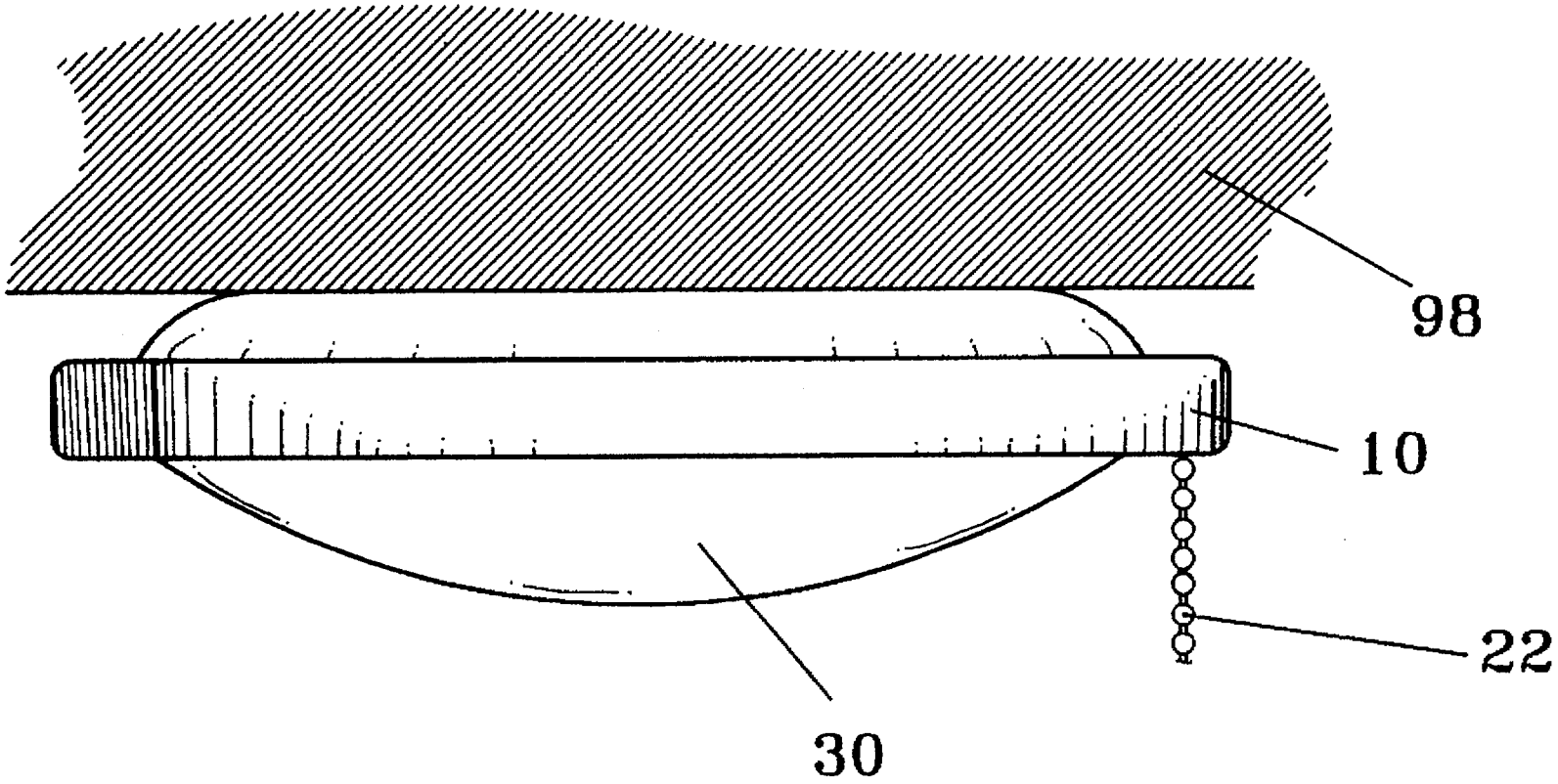

Referring next to FIGS. 5 and 6, the housing 10 may be secured to the lower portion of a ceiling fan 97 and may be directly secured to the ceiling 98 of a room. The switch is received and shielded within the housing 10 such that the switch will not spoil the outer appearance of the housing 10. In addition, the nut is not engaged with the outer surface of the housing 10 such that the outer painting layer of the housing 10 will not be damaged by the nut.

Accordingly, the lamp device in accordance with the present invention includes a switch which is received and shielded within the housing such that the switch will not spoil the outer appearance of the housing. In addition, the outer painting layer of the housing will not be damaged by the fastening nut.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lamp device comprising:

a housing including at least one resilient blade disposed therein and extended downwardly therefrom, and including a lower peripheral flange extended radially inwardly therefrom, said peripheral flange including at least one opening formed therein, a plate including a panel extended downwardly therefrom, means for fixing said plate to said housing, a switch fixed to said panel and including a chain extended downwardly therefrom and engaging with said opening of said peripheral flange, said opening allowing said chain to be extended outwardly of said housing, a cover made of light transmissible material and engaged in said housing, said cover including a peripheral rib extended radially outwardly therefrom, said rib engaging with said peripheral flange of said housing so as to be supported in said housing, said resilient blade being engaged with said peripheral rib of said cover and stably retaining said cover in place.

2. A lamp device according to claim 1, wherein said peripheral rib includes at least one notch engaging with said switch so as to allow said cover to be engaged inwardly of said housing.

* * * * *